US006062404A

United States Patent [19]

Erdmann

[11] Patent Number: 6,062,404

[45] Date of Patent: May 16, 2000

[54] DEVICE AND METHOD FOR ARRESTING SECTIONS OF A TELESCOPIC JIB

[75] Inventor: Gerd Erdmann, Oldenburg, Germany

[73] Assignee: Grove U.S. L.L.C., Shady Grove, Pa.

[21] Appl. No.: 08/993,526

[22] Filed: Dec. 18, 1997

[30] Foreign Application Priority Data

Dec. 20, 1996 [DE] Germany ..... 196 53 502

[51] Int. Cl.[7] ..... B66C 23/04

[52] U.S. Cl. ..... 212/292; 212/350

[58] Field of Search ..... 212/350, 292; 52/118

[56] References Cited

U.S. PATENT DOCUMENTS

| | | | |
|---|---|---|---|
| 808,632 | 1/1906 | Brown . | |
| 2,204,713 | 6/1940 | White, Jr. . | |
| 2,560,412 | 7/1951 | Calvert . | |
| 2,949,692 | 8/1960 | Kuhn . | |
| 3,092,261 | 6/1963 | Nesbit | 212/292 |
| 3,266,598 | 8/1966 | Henne . | |
| 3,269,561 | 8/1966 | Ligt . | |
| 3,398,492 | 8/1968 | Nansel . | |
| 3,495,370 | 2/1970 | Habro et al. . | |
| 3,638,804 | 2/1972 | Blakeway et al. | 212/292 |
| 3,863,406 | 2/1975 | Quick | 212/292 |
| 3,952,466 | 4/1976 | Spain . | |
| 4,036,372 | 7/1977 | Rao et al. . | |
| 4,257,201 | 3/1981 | Landolt et al. . | |
| 4,436,476 | 3/1984 | Yoritomi . | |
| 4,621,972 | 11/1986 | Grotte . | |
| 5,158,189 | 10/1992 | Watson et al. . | |
| 5,465,854 | 11/1995 | Sturm et al. . | |

FOREIGN PATENT DOCUMENTS

| | | | |
|---|---|---|---|
| 0661234 A1 | 7/1995 | European Pat. Off. . | |
| 1015618 | 10/1952 | France . | |
| 2235077 | 1/1975 | France . | |
| 2236771 | 2/1975 | France . | |
| 2626511 | 12/1977 | Germany . | |
| 2757040 | 7/1979 | Germany . | |
| 3338508 | 5/1984 | Germany . | |
| 3404204 | 8/1985 | Germany . | |
| 1368253 | 1/1988 | U.S.S.R. | 212/350 |
| 1615145 | 12/1990 | U.S.S.R. | 212/350 |
| 1625818 | 2/1991 | U.S.S.R. | 212/292 |
| 2125004 | 2/1984 | United Kingdom | 212/350 |
| 2201942 | 9/1988 | United Kingdom . | |

*Primary Examiner*—Thomas J. Brahan

*Attorney, Agent, or Firm*—Birch, Stewart, Kolasch & Birch, LLP

[57] ABSTRACT

The device and method for arresting movement of sections in a telescopic jib, which includes at least a first section and a second section and a telescopic cylinder telescoping the second section along a longitudinal axis of the telescopic jib relative to the first section, telescopes the second section using the telescopic cylinder to a desired working position. Then, movement of the second section is arrested using at least one sliding element connected and moveable with respect to the second section. The sliding element is disposed between the first and second sections, and arrests movement of the second section with respect to the first section when in an arresting position.

31 Claims, 2 Drawing Sheets

DEVICE AND METHOD FOR ARRESTING SECTIONS OF A TELESCOPIC JIB

BACKGROUND OF THE INVENTION

1. Field of the Invention

The invention relates to a device for arresting/de-arresting a telescopically extensible section of a telescopic jib (i.e., boom) and a method for arresting/de-arresting these sections.

2. Description of Related Art

It is known to pin the individual sections of a telescopic jib. Pinning serves to relieve the load on a telescoping system once a section of the telescopic jib has been telescoped to a working position. For this pinning, individual pinning points must be provided.

Pinning points, however, are complicated to design, and are only provided in a limited number (e.g., two pinning points being placed for each extendable jib section) so that each telescopically extensible section has an equally limited number of working positions. It is only in these working positions that it is possible to make full use of the telescopic jib, (i.e., loading the telescopic jib to maximum permissible capacity). Between these two pinning points the individual sections cannot be pinned, and can only handle minor forces. As a result, only low loads may be lifted by the telescopic jib when a section is in an intermediate position. In addition, suitable length/position sensing instruments are required to bring the section to be pinned precisely into the position for pinning.

One such pinning system for a telescopic jib is described in European Patent 0 661 234 A1.

SUMMARY OF THE INVENTION

An object of the present invention is to provide a method and apparatus for arresting a section of a telescopic jib which overcomes the problems and disadvantages discussed above.

Another object of the present invention is to provide a device and a method for arresting a section of a telescopic jib in any position.

A further object of the present invention is to provide a device and a method for arresting a section of a telescopic jib in any position by actuating elements used to arrest the section.

A still further object of the present invention is to provide a device and a method for arresting a section of a telescopic jib in any position which does not require actuating elements to arrest the section.

Also an object of the present invention is to provide a device and a method for arresting a section of a telescopic jib which does not require position sensing instruments.

These and other objects are achieved by providing a crane comprising: a telescopic jib having at least a first section and a second section; a telescopic cylinder telescoping said second section along a longitudinal axis of said telescopic jib relative to said first section; and at least one sliding element connected and moveable with respect to said second section, and disposed between said first and second sections, said sliding element arresting movement of said second section with respect to said first section when in an arresting position.

These and other objects are further achieved by providing a method of arresting movement of at least one section in a telescopic jib which includes at least a first section and a second section, and a telescopic cylinder telescoping said second section along a longitudinal axis of said telescopic jib relative to said first section, the method comprising: telescoping said second section using said telescopic cylinder to a desired working position; and arresting movement of said second section using at least one sliding element connected and moveable with respect to said second section, said sliding element being disposed between said first and second sections, and arresting movement of said second section with respect to said first section when in an arresting position.

Other objects, features, and characteristics of the present invention; methods, operation, and functions of the related elements of the structure; combination of parts; and economies of manufacture will become apparent from the following detailed description of the preferred embodiments and accompanying drawings, all of which form a part of this specification, wherein like reference numerals designate corresponding parts in the various figures.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
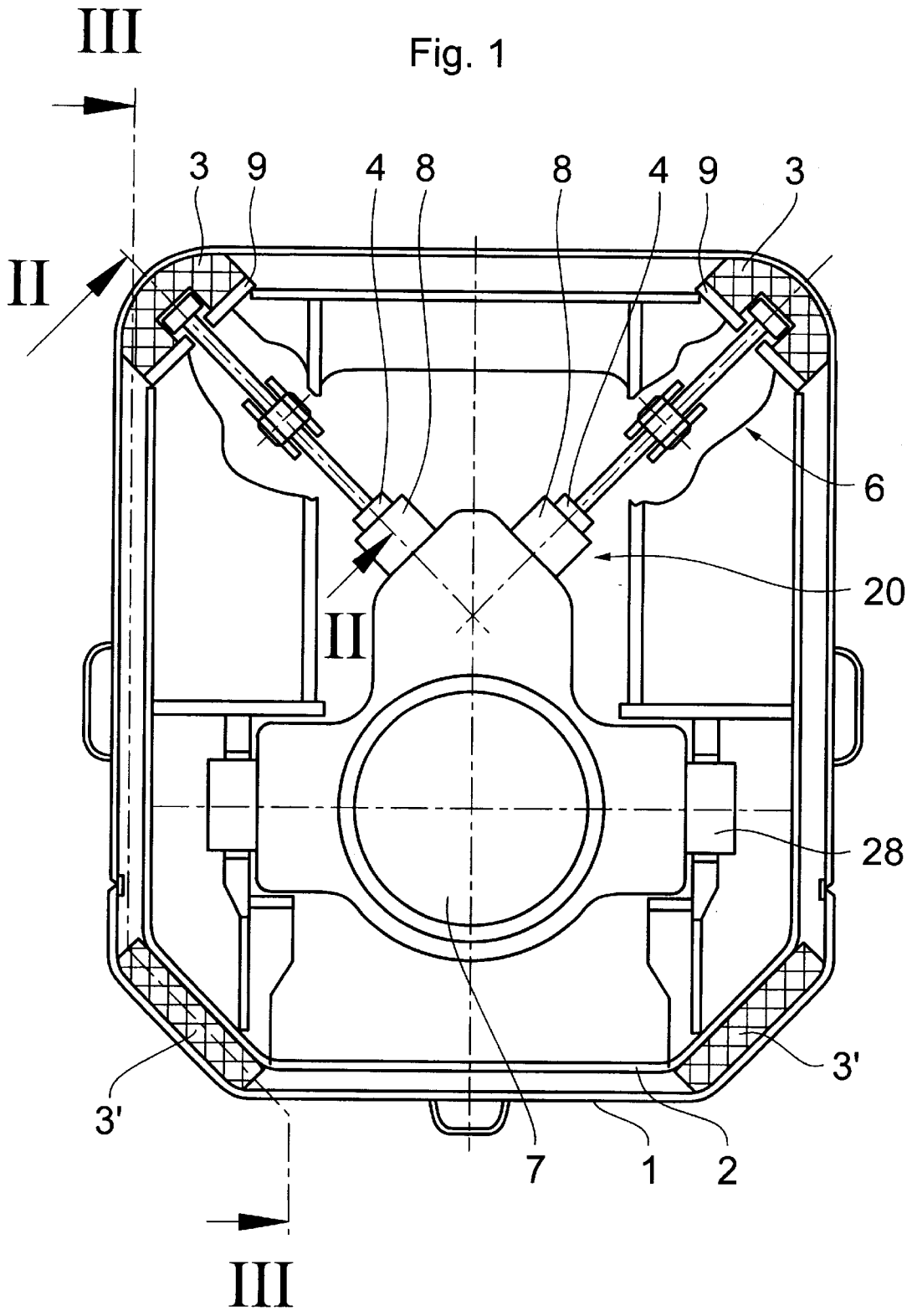
FIG. 1 is a transverse section through a telescopic jib according to the present invention.

FIG. 1 illustrates a cross-section of the telescopic jib according to the present invention. As shown, the telescopic jib includes an outer section 1 and an inner section 2 each having a substantially rectangular shape. The upper corners of the outer section 1 are rounded, while flat sides are at the lower corners of the outer section 1. Similarly, flat sides are at the lower corners of the inner section 2. By contrast, inclined guide surfaces 9 are at the upper corners of the inner section 2.

Auxiliary sliding elements 3' are disposed between the flat sides at the lower corners of the inner and outer sections 2 and 1, and are connected to the inner section 2. Similarly, sliding elements 3 are disposed between the rounded upper corners of the outer section 1 and the inclined guide surfaces 9 at the upper corners of the inner section 2. The auxiliary sliding elements 3' and the sliding elements 3 are made of a plastic material such as polyamide.

A kinematic system 6 connects the sliding elements 3 to the inner section 2 such that the sliding elements 3 move with respect to the inner section 2.

As further shown in FIG. 1, the telescopic jib includes a telescoping cylinder 7 having extendable and retractable pins 28 for engaging holes in the inner section 2. Accordingly, when pinned to the inner section 2, the telescoping cylinder 7 can extend and retract the inner section 2 with respect to the outer section 1. Instead of a telescopic cylinder 7, other known mechanisms could be used to extend and retract the inner section 2 relative to the outer section 1.

Figure 2:
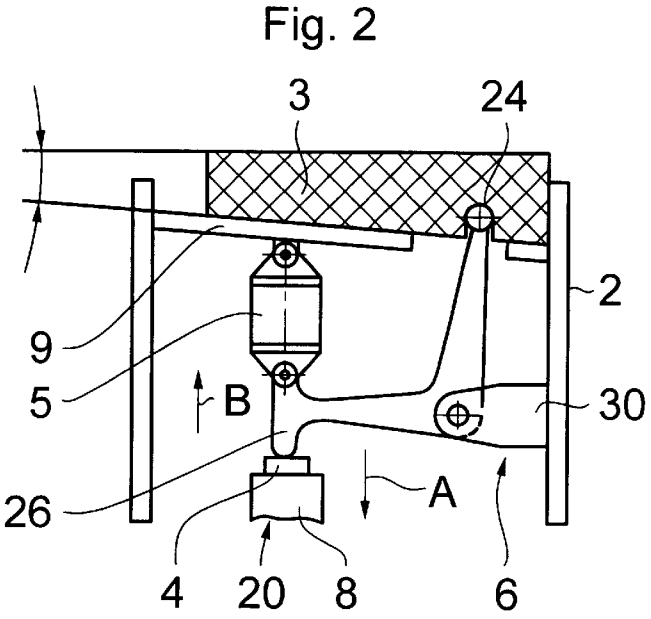
FIG. 2 is a cross-sectional view along the line II—II in FIG. 1.
Figure 3:
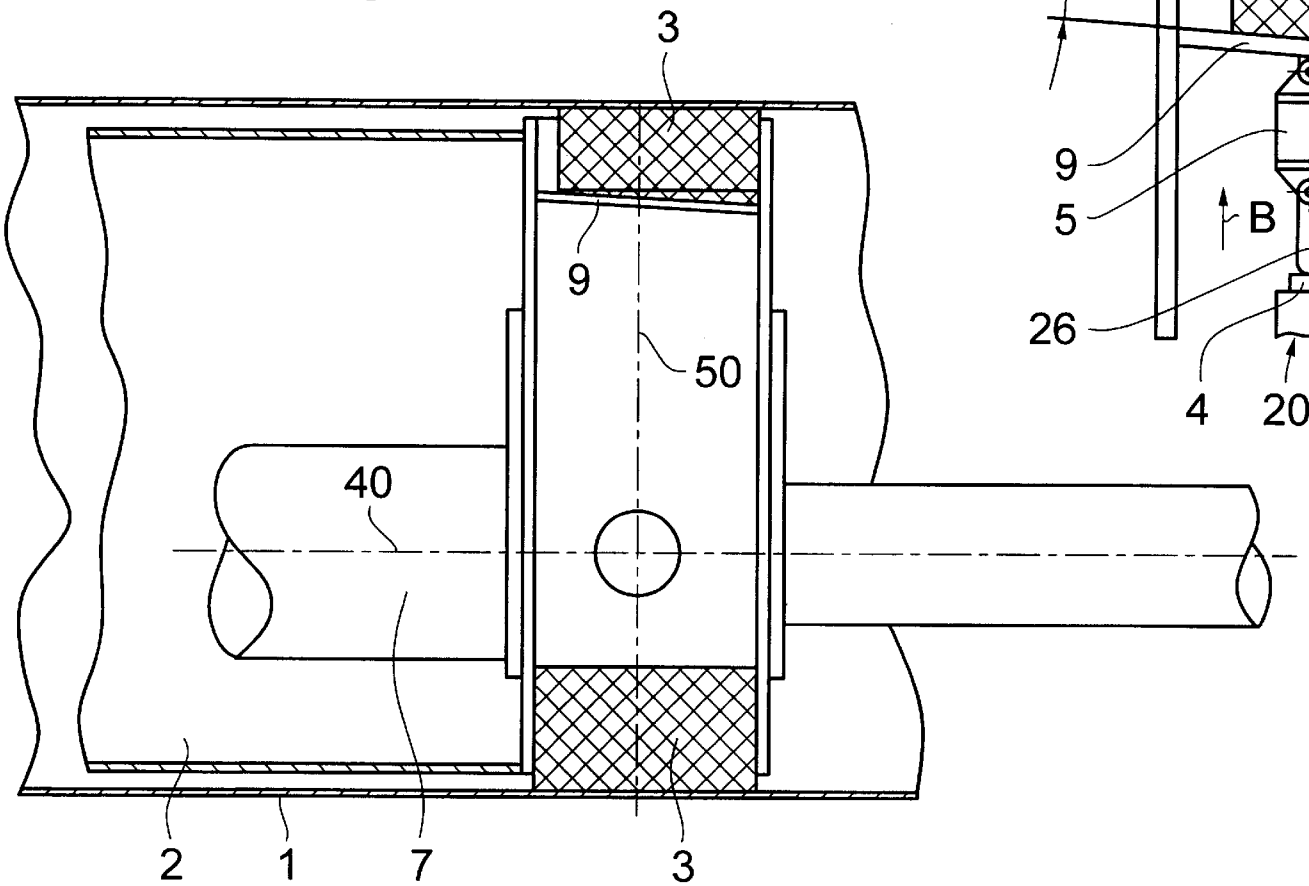
FIG. 3 is a cross-sectional view along the line III—III in FIG. 1.

FIG. 2 illustrates a cross-section of the telescopic jib according to the present invention along line II—II in FIG. 1, and FIG. 3 illustrates a cross-section of the telescopic jib along line III—III in FIG. 1. FIGS. 2 and 3 illustrate one of the kinematic systems 6, the sliding elements 3, and the auxiliary sliding elements 3' in greater detail. As shown in FIG. 2, the kinematic system 6 includes an angle member 22 pivotally connected to the inner section 2 at its elbow by a bracket 30. A first end 24 of the angle member 22 is pivotally connected to the sliding element 3. A T-shaped second end 26 of the angle member 22 is connected to the guide surface 9 by a spring storage mechanism 5. The spring storage mechanism 5 exerts a force on the second end 26 away from the guide surface 9 as indicated by an arrow A.

As shown in FIGS. 1 and 2, the telescopic cylinder 7 also includes piston/cylinder units 20 which respectively contact the second end 26 of the angle members 22 in each kinematic system 6 when the telescoping cylinder 7 is pinned to the inner section 2. The piston/cylinder units 20 include a cylinder 8 and a piston 4, and are preferably hydraulic or pneumatic. When the piston 4 extends, the piston 4 exerts a force on the second end 26 of the angle member 22 which opposes the force applied by the spring storage mechanism 5.

As shown in FIGS. 2 and 3, the guide surfaces 9 are inclined with respect to the longitudinal axis of the telescopic jib. The guide surfaces 9 are inclined at an angle of 2 to 30° with respect to the longitudinal axis of the telescopic jib; and, preferably, inclined at an angle of 5 to 15° with respect to longitudinal axis of the telescopic jib. Also, the thickness of the sliding elements 3 increases from a distal end of the telescopic jib to a proximal end of the telescopic jib, and matches the inclination of the guide surfaces 9.

FIG. 3 illustrates the sliding elements 3, the auxiliary sliding elements 3', and the kinematic systems 6 positioned at the base of the inner section 2. It should be understood that the sliding elements 3, the auxiliary sliding elements 3', and the kinematic systems 6 are not limited to being positioned at the base of the inner section 2, but could be positioned, for instance, at the head of the inner section 2.

The operation of the present invention will now be described with respect to FIGS. 1–3. After the pins 28 of the telescoping cylinder 7 engage the inner section 2, the pistons 4 of the piston/cylinder units 20 on the telescoping cylinder 7 extend. As a result, the force applied by the pistons 4 on the angle members 22 counteracts and overcomes the force exerted by the spring storage mechanisms 5 such that the angle members 22 pivot and move the sliding elements 3 in a longitudinal direction parallel to axis 40 towards the proximal end of the telescopic jib and/or a radial direction 50 inwardly towards the guide surfaces 9. As a result, the sliding elements 3 move into the relatively greater width spaces between boom sections 1 and 2 resulting from the inclination the guide surfaces 9. In other words, the sliding elements 3 do not need to be moved in the longitudinal direction to arrest movement of the inner section 2. In this unlocked state, shown in FIG. 2, the telescoping cylinder 7 extends or retracts the inner section 2 with respect to the outer section 1 until a desired working position is achieved.

Once at a desired working position, the pistons 4 are retracted. As a result, the spring storage mechanisms 5 exert a force on the second end 26 of the angle members 22 such that the sliding elements 3 move in the longitudinal direction parallel to axis 40 towards the distal end of the telescopic jib and/or the radial direction 50 outwardly away from the guide surfaces 9. The sliding elements 3 act as brake blocks due to the resulting contact force between the sliding elements 3 and the inner surface of the outer section 1 and the guide surfaces 9, and arrest movement of the inner section 2 with respect to the outer section 1. The arrangement of the sliding elements 3 and the auxiliary sliding elements 3' places tension, circumferentially, on the outer section 1 when arresting the inner section 2. The telescoping cylinder 7 can then be unpinned from the inner section 2, and the same operation performed with respect to other sections (not shown) of the telescopic jib which have kinematic systems and sliding elements associated therewith.

When a load is placed on the telescopic jib, the load exerts a force on the inner section 2 such that the contact force between the sliding elements 3 and the inner surface of the outer section 1 and the guide surfaces 9 increases. As the load on the telescopic jib increases, the contact pressure increases so that stable and secure locking of the inner section 2 relative to the outer section 1 is achieved, and unwanted retraction of the inner section 2 is prevented. Consequently, arresting the inner section 2 does not require the use of spring storage mechanisms 5 exerting a force away from the guide surfaces 9 to move the sliding elements 3 into an arresting position. Instead, automatic arresting of the inner section 2 can be achieved when a load is placed on the telescopic jib.

To de-arrest the second section 2, it is preferable to first unload the telescopic jib. Then, the telescoping cylinder 7 is pinned to the inner section 2, and the pistons 4 are extended to counteract and overcome the force applied to the angle member 22 by the spring storage mechanisms 5. The force applied by the pistons 4, causes the angle member 22 to pivot and move the sliding elements 3 away from the arresting position such that the telescoping cylinder 7 can extend or retract the inner section 2 relative to the outer section 1.

While the present invention has been described as using two sliding elements 3 and two auxiliary sliding elements 3', the number of sliding elements and auxiliary sliding elements is not limited to two, but could be greater than or less than two with an associated increase or decrease in the number of the kinematic systems 6.

Furthermore, the spring storage mechanisms 5 have been described as exerting a force on the second end 26 of the angle members 22 away from the guide surfaces 9. In an alternate embodiment, the spring storage mechanisms 5, of FIG. 2 bias the second end 26 of the angle members 22 towards the guide surfaces 9 as indicated by an arrow B such that the sliding elements 3 are biased towards an unlocked position. This eliminates the need for the piston/cylinder units 20, and the inner section 2 is arrested by loading the telescopic jib as discussed above.

As mentioned above, besides being applicable to a two-section telescopic jib, the present invention is applicable to a multi-section telescopic jib wherein kinematic systems and sliding elements are provided for each telescoping section.

Furthermore, it will be appreciated that the present invention while described as being applicable to telescopic jibs such as used in cranes, is also applicable to other telescoping extensible elements such as telescoping antennas.

The device and method for arresting movement of a telescopic jib according to the present invention makes it possible to lock or arrest a section of the telescopic jib in any position without being bound to specific working positions dictated by pinning point designs. Accordingly, pinning points are no longer needed for arresting sections of a telescopic jib, which eliminates the need for position sensing instruments, and the telescopic jib can be used to its maximum capacity in any desired working position.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A crane comprising:

a telescopic jib having at least a first section and a second section;

means for telescoping said second section along a longitudinal axis of said telescopic jib relative to said first section;

a substantially smooth first surface formed on said first section;

a substantially smooth second surface formed on said second section, said second surface having an inclination relative to said first surface, such that said second surface and said first surface are nonparallel; and a sliding element residing between said first surface and said second surface, said sliding element being movable between a first position on said second surface wherein said sliding element engages both said second surface and said first surface to arrest telescoping movement of said second section relative to said first section, and a second position along said second surface wherein said sliding element engages only one of said first and second surfaces and allows said second section to telescope relative to said first section.

2. The crane of claim 1, further comprising:

auxiliary sliding elements connected to said second section, and disposed between said first and second sections, said auxiliary sliding elements and said sliding element placing tension, circumferentially, on said first section when said sliding element is in said first position.

3. The crane of claim 1, wherein said second surface is inclined with respect to said longitudinal axis of said telescopic jib.

4. The crane of claim 3, wherein said second surface is inclined at an angle of 2 to 30 degrees with respect to said longitudinal axis of said telescopic jib.

5. The crane of claim 3, wherein said second surface is inclined at an angle of 5 to 15 degrees with respect to said longitudinal axis of said telescopic jib.

6. The crane of claim 3, wherein said sliding element has a thickness which increases in a direction along said longitudinal axis from a distal end to a proximal end of said telescopic jib.

7. The crane of claim 6, wherein said thickness of said sliding element increases corresponding to said inclination of said guide surface.

8. The crane of claim 1, wherein said sliding element has a thickness which increases in a direction along said longitudinal axis from a distal end to a proximal end of said telescopic jib.

9. The crane of claim 1, wherein said sliding element moves in at least one of a longitudinal direction and a radial direction of said telescopic jib.

10. The crane of claim 1, further comprising:

control means for controlling movement of said sliding element.

11. The crane of claim 10, wherein said control means comprises:

biasing means for biasing said sliding element towards said first position; and actuator means for moving said sliding element towards said second position.

12. The crane of claim 1, further comprising:

an angular member having a first and second end, said angular member pivotally attached to said second section and said first end connected to said sliding element; and a spring element connected to said second end of said angular member to pivotally bias said angular member in a first direction such that said sliding element is biased towards said first position.

13. The crane of claim 12, further comprising:

an actuator, connected to said means for telescoping, selectively acting on said second end of said angular member to pivot said angular member in a second direction, opposite said first direction, such that said sliding element is moved toward said second position.

14. The crane of claim 13, wherein said sliding element moves in at least one of a longitudinal direction and a radial direction of said telescopic jib.

15. The crane of claim 1, wherein said sliding element is connected to said second section near one of a proximal and a distal end of said second section.

16. The crane of claim 1, further comprising:

more than one sliding element.

17. The crane of claim 1, further comprising:

at least one auxiliary sliding element connected to said second section.

18. The crane of claim 17, wherein said at least one auxiliary sliding element is connected to an opposite side of said second section from said sliding element.

19. The crane of claim 1, further comprising:

spring means for biasing said sliding element towards said first position.

20. The crane of claim 1, further comprising:

spring means for biasing said sliding element toward said second position.

21. The crane of claim 1, wherein said sliding element is connected to said second section such that loading of said telescopic jib causes said sliding element to achieve said first position.

22. The crane of claim 1, wherein said first surface is formed on an inner surface of said first section and said second surface is formed on an outer surface of said second section.

23. The crane of claim 1, wherein said sliding element is connected to said second section.

24. The crane of claim 1, wherein said sliding element includes a first substantially smooth side for engaging said first surface of said first section and a second substantially smooth side for engaging said second surface of said second section.

25. A method of arresting movement between a first section and a second section of a telescopic jib, the method comprising:

telescoping said second section relative to said first section, to a desired working position; and arresting movement of said second section, using a sliding element residing between a smooth first surface formed on said first section and a smooth second surface formed on said second section, with said second surface having an inclination relative to said first surface such that said second surface and said first surface are nonparallel, wherein said arresting step occurs by moving said sliding element to a first position on said second surface wherein said sliding element engages both said second surface and said first surface.

26. The method of claim 25, wherein, prior to said arresting step, the method comprises:

unloading said telescopic jib.

27. The method of claim 25, wherein said arresting step comprises:

biasing said sliding element towards said first position.

28. The method of claim 25, wherein said arresting step comprises:

loading said telescopic jib such that said sliding element achieves said first position.

29. The method of claim 25, further comprising:

de-arresting said second section by moving said sliding element away from said first position.

30. The method of claim 29, wherein said de-arresting step includes applying a force to said sliding element using an actuator.

31. The method of claim 29, wherein said de-arresting step comprises:

unloading said telescopic jib.

* * * * *